United States Patent [19]

Fekete

[11] 4,107,367

[45] Aug. 15, 1978

[54] PAPERMAKERS FELTS

[75] Inventor: Eugene Zoltan Fekete, Vienna, Austria

[73] Assignee: Huyck Corporation, Wake Forest, N.C.

[21] Appl. No.: 807,271

[22] Filed: Jun. 16, 1977

Related U.S. Application Data

[63] Continuation-in-part of Ser. No. 738,208, Nov. 3, 1976, abandoned.

[51] Int. Cl.[2] ..... B32B 5/06

[52] U.S. Cl. ..... 428/234; 28/110; 34/243 F; 139/383 A; 162/358; 428/246; 428/280; 428/282; 428/297; 428/300; 428/397

[58] Field of Search ..... 428/234, 236, 246, 252, 428/280, 282, 297, 300, 397, 233, 235, 236, 401; 156/148; 162/358; 34/243 F; 28/110; 139/383 A

[56] References Cited

U.S. PATENT DOCUMENTS

| | | | |
|---|---|---|---|
| 2,464,301 | 3/1949 | Francis | 428/280 |
| 2,528,129 | 10/1950 | Francis | 428/235 |
| 2,581,790 | 11/1952 | Gates | 428/234 |
| 2,908,064 | 10/1959 | Lauterbach | 428/300 |
| 2,910,763 | 11/1959 | Lauterbach | 428/300 |
| 2,958,113 | 11/1960 | Lauterbach | 428/300 |
| 3,235,935 | 2/1966 | Darwallo | 428/300 |
| 3,924,040 | 12/1975 | Addie et al. | 428/280 |
| 3,928,699 | 12/1975 | Fekete | 428/300 |

*Primary Examiner*—James J. Bell
*Attorney, Agent, or Firm*—Sanford S. Wadler

[57] ABSTRACT

The present invention relates to a novel felt construction for use in the press section of the papermaking machine. More particularly, this invention has to do with a papermakers' felt having a paper-sheet-contacting layer comprised of substantially flat fibers joined by any suitable means to either a woven or nonwoven intermediate batt layer and/or base layer.

10 Claims, 2 Drawing Figures

PAPERMAKERS FELTS

REFERENCE TO RELATED APPLICATION

This application is a continuation-in-part of application Ser. No. 738,208, filed Nov. 3, 1976 now abandoned.

BACKGROUND OF THE INVENTION

In general, press felts are used in papermaking machines to support the moist, freshly formed paper web as it encounters a variety of rolls which serve to extract water from the moist paper web. In addition to serving as a support for the paper web, the press felt serves as a receptacle for the water removed from the paper sheet. The press felt normally has a conveyor belt-like shape and during the various operations previously mentioned, a large amount of water is built up in the press felt which is removed by suction or various other drainage devices, usually after the paper web and press felt are no longer in direct contact. During the break-in or start-up period of most prior art felts, it is usually necessary to run the papermaking machine at a reduced speed and/or to increase the heat energy flowing into the dryer section. Since the amount of paper produced by a papermaking machine is largely dependent upon the speed of the machine, any slowing down caused by, for example, the required break-in period in papermakers' felts, results in the machine functioning at less than optimum economic efficiency.

Paper sheet dewatering, sheet surface smoothness, sheet pick-up and sheet carrying, as well as a variety of other performance characteristics, are sensitive to felt design. It has been observed that the physical characteristics of felts change during their useful operating life, the greatest change occurring during the first several hours of felt operation. Most press felts require an initial start-up period before peak water removal efficiency is achieved. This start-up period usually lasts for several hours and, in some cases, as much as several days. During the start-up period, press felt performance may be unsatisfactory in terms of optimum water removal from the paper web and pick-up and carrying of the paper web from the adjacent forming section or from an adjacent felt, thereby resulting in lost paper production and/or higher paper production costs due to lower operating speeds.

The subject of the present invention is a felt structure designed to substantially reduce or eliminate the problem of relatively poor paper machine performance during the early part of felt life. The new structure is based on the observation that the originally round or irregularly shaped felt surface fibers tend to flatten out during operation. As surface fibers flatten, the area of interface between felt and paper increases leading to greater adhesion between felt and sheet and therefore to improved sheet pick-up and sheet carrying performance. In addition, the increased sheet/felt interface area provides a more effective sheet support in the press leading to more efficient sheet dewatering. However, since fiber flattening under papermaking conditions requires time, during the early part of felt life the papermaker must do without the resultant benefits.

SUMMARY OF THE INVENTION

The present invention teaches the construction of felts with flat fibers already present in the sheet-contacting surface of the new felt, rather than await the natural process of fiber deformation, in order to substantially, or in some cases totally, eliminate the early period of relatively poor performance.

In utilizing a sheet-contacting layer comprising flat fibers as opposed to round or irregularly shaped fibers as has been used in the prior art, it is possible to increase the actual area available on the surface of the felt for contact with the paper web. Without intending to present any particular theory of operation of the present invention, it is believed that felts having a surface-contacting layer comprising flat fibers allow a more efficient transfer of water between the paper web and press felts when the mechanical forces of the presses present in the press section of the paper machine act on the paper web to transfer the water contained in the paper web to the press felt.

The use of flat fibers in the sheet-contacting layer allows for a relatively smooth surface to be presented to the paper web which comes in contact with the felt structure. The result of this is that marking of the paper web is minimized. Further, by utilizing flat fibers in the sheet-contacting layer as described herein, it is also possible to reduce the tendency of the felt to fill up. By filling up, it is meant the action of wood fibers and small particles of other materials in the pulp to accumulate below the surface layer of a papermakers' felt so as to interfere with proper water removal, thereby reducing the efficiency of the papermaking process in the press section. The reduced filling up tendency is believed to occur because of the high fiber density present in the sheet-contacting layer of felts constructed in accordance with the invention. The high density flat fibers on the surface of the felt tend to retard the ability of the particles on the surface of the felt to work their way below the sheet-contacting layer so as to prevent their being easily removed by conventional felt-cleaning equipment which usually takes the form of a high pressure shower directed at the surface of the felt subsequent to its contact with the paper web.

In addition, felts constructed with a sheet-contacting layer comprised of flat fibers possess desirable properties with regard to paper web pick-up. By paper web pick-up, it is meant the ability of a press felt to transport the moist paper web as it leaves the forming fabric or wire which is the first step in the paper-forming process. It is sometimes the case that the sheet, instead of attaching itself to the felt as it leaves the forming fabric, will instead move off the paper machine, thus causing a loss in the paper production process. Since the sheet-contacting layer of the present invention has a greater available surface area for contact with the paper web than prior art felts, it is believed that it will exhibit substantially better sheet pick-up properties than have heretofore been possible.

Accordingly, it is an object of the present invention to provide a papermakers' felt having a sheet-contacting layer comprised of flat fibers.

Another object of the present invention is to provide a papermakers' felt having increased surface fiber area available for pressing the paper web.

It is another object of this invention to provide a papermakers' felt which eliminates the extensive break-in or start-up period required with most prior art papermakers' felts.

Another object of the present invention is to provide a papermakers' felt having a smooth paper contacting surface.

It is still another object of this invention to provide a papermakers' felt having a paper web contacting surface allowing improved paper web pick-up.

It is another object of this invention to provide a papermakers' felt having excellent water removal properties.

A further object of the present invention is to provide a papermakers' felt having desirable resistance to fill-up.

DESCRIPTION OF THE PREFERRED EMBODIMENTS

Figure 1:
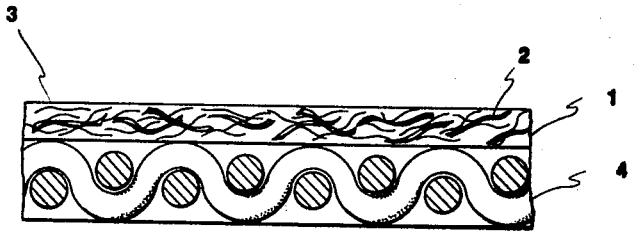
FIG. 1 is a schematic cross-sectional view showing on an enlarged scale the structure of the sheet-contacting layer applied to a woven base layer.
Figure 2:
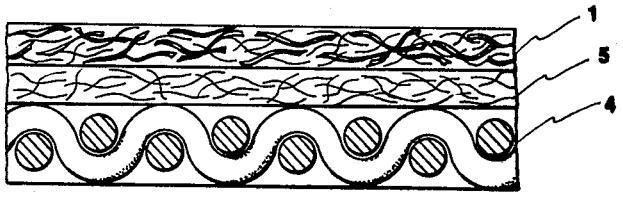
FIG. 2 is a schematic cross-sectional view similar to FIG. 1 showing another embodiment of the present invention.

Referring first to FIG. 1 of the drawing, a nonwoven sheet contacting layer 1 containing flat fibers as well as conventional fibers 3 is deposited on and directly joined to a base layer 4, which in the embodiment illustrated, comprises a woven fabric. The sheet-contacting layer 1 may be joined to the base layer 4 in any conventional fashion, preferably by needling. In another embodiment of the invention, illustrated in FIG. 2, the sheet-contacting layer 1 is joined to the base layer 4 through an intermediate batt of nonwoven fibers which may comprise either natural or synthetic fibers, such batt layer adding additional bulk and water reception properties to the structure. As in the case of the sheet-contacting layer 1, the batt layer 5 may be joined to the fabric in any conventional manner, and both the sheet-contacting layer and the batt layer may be joined to the base layer 4 by one or more joint needling operations.

In accordance with the invention, the sheet-contacting layer 1 in either of the foregoing embodiments may be composed entirely of flat fibers, although preferably it will comprise a blend of flat and conventional fibers, as has been illustrated. The term flat fibers as used herein is meant to refer to fibers whose perpendicular diameters have a ratio of 3:1 or greater, i.e. fibers with cross-sectional dimensions which are at least three times as long as they are wide, and are to be contrasted with the normal circular fibers which are known to be used in constructing the batt or surface layer of prior art papermakers' felts. In this connection, reference is made to Fekete, U.S. Pat. No. 3,392,079; Mizell, U.S. Pat. No. 3,030,690; and Walsh, U.S. Pat. No. 215,772. Preferably, the flat fibers will constitute at least 50% of the fibers of the sheet-contacting layer. However, depending upon the particular press configuration and paper machine design, as little as 10% flat fibers may be used. The cross-sectional dimensions of the flat fibers also will have a bearing on the composition of the sheet-contacting layer. For example, flat fibers having a 3:1 cross-sectional ratio would tend to permit fewer conventional fibers than a 4:1 or 7:1 ratio.

The flat fibers can be formed from any of the well-known natural or synthetic fibers which are usually used in constructing papermakers' felts, including such animal fibers as wool, as well as such synthetic fibers as polyacrylics, such as Orlon, polyesters, such as Dacron, and polyamides, such as Nylon. Likewise, the remaining portion of the sheet-contacting layer may be made from any of the synthetic fibers which have been previously mentioned. Similarly, the batt layer 5 can be composed of any of the aforementioned types of fibers. The sheet-contacting layer 1 and the intermediate batt layer 5 can be formed by carding, air-laying or other well-known procedures which are effective to orient the fibers in a uniform manner as to thickness and density. Alternatively, the intermediate batt layer may be of a woven construction.

Although not shown, it is contemplated that the use of flat fibers in the sheet-contacting layer 1 may be incorporated in a number of prior art felt structures, such as described in Fekete, U.S. Pat. No. 3,928,699 and Wicker et. al., U.S. Pat. No. 3,214,327, both of which teach dual layer felt construction to which the sheet-contacting layer of the present invention can be applied. In addition, one or more layers may be inserted in multiple planes between the base layer 4 and the sheet-contacting layer 1, and it is to be understood that the term sheet-contacting layer means the layer of the felt which comes into contact with the paper web. It also will be understood that the base layer 4 will be formed from either natural or synthetic materials of the types previously mentioned in connection with the sheet-contacting and batt layers. The sheet-contacting and the batt and base layers can be joined to one another by mechanical methods, such as needling in a needle loom, or by the use of adhesives. The base layer may be a woven structure having a plain weave, or any other suitable weave configuration may be used, such as twill or four-harness satin. Alternately, the base layer may comprise a nonwoven fabric.

The following example illustrates a felt constructed according to the teachings of the present invention:

A base layer was woven endless with a reverse broken twill weave containing approximately 4.2 warp yarns per centimeter and 7.1 weft yarns per centimeter. The weft and warp yarns were Nylon and the weight of the base layer was approximately 560 g/m$^2$.

The intermediate nonwoven batt layer was made of Nylon fibers, approximately 7.6 centimeters in length and 43 microns in diameter. It was needled on top of the woven base layer in two layers whose combined weight was 435 g/m$^2$.

The sheet-contacting layer was made of a blend of Nylon fibers having a diameter of about 43 microns and modacrylic fibers having approximately a height of 8.4 microns, a width of 59 microns and a length of 11.4 centimeters. The weight of Nylon fibers was about 92 g/m$^2$ and that of the modacrylic was the same. The sheet-contacting layer was needled on top of the intermediate batt layer in a single layer weighing about 184 g/m$^2$. The total weight of the finished felt was approximately 1180 g/m$^2$.

While the present invention makes frequent reference to the term papermakers' felt, it should be understood that the invention is also applicable to dryer felts which are used to convey a paper web through the drying section of the paper machine. The various embodiments, terms and references to a particular material which have been employed herein are used only by way of description and not of limitation, and there is no intention for any of the above to exclude any equivalents thereof. Hence, it is recognized that various modifications are possible within the scope of the present invention as claimed.

Having disclosed my invention I claim it as follows:

1. In a felt for use in a papermaking machine, the improvement which comprises a nonwoven sheet-contacting layer for said felt, said sheet-contacting layer as initially formed being composed of at least a minor proportion of flat fibers having cross-sectional dimensions which are longer than they are wide, the remainder of the fibers in said sheet-contacting layer being of other than flat fibers, said sheet-contacting layer being joined to one surface of said felt.

2. The felt structure claimed in claim 1 wherein said sheet-contacting layer contains at least 10% flat fibers.

3. The felt structure claimed in claim 1 wherein said sheet-contacting layer contains more than 50% flat fibers.

4. The felt structure claimed in claim 1 wherein said sheet-contacting layer is needled to said felt.

5. The felt structure claimed in claim 1 wherein said felt has a base layer, and wherein said sheet-contacting layer is joined directly to said base layer.

6. The felt structure claimed in claim 5 wherein said base layer comprises a woven fabric.

7. The felt structure claimed in claim 1 wherein said felt has a base layer and a batt layer joined to one surface of said base layer, with said sheet-contacting layer joined to the opposite surface of said batt layer.

8. The felt structure claimed in claim 7 wherein both said sheet-contacting layer and said batt layer are needled to each other and to said base layer.

9. The felt structure claimed in claim 8 wherein said base layer comprises a woven fabric.

10. The felt structure claimed in claim 1 wherein said flat fibers have a cross-sectional length to width ratio of at least 3:1.

* * * * *